United States Patent [19]

Kaufman

[11] Patent Number: 4,642,180

[45] Date of Patent: Feb. 10, 1987

[54] PORTABLE APPARATUS FOR THE RECOVERY OF PLACER GOLD

[76] Inventor: Norman H. Kaufman, P.O. Box 12663, Las Vegas, Nev. 89112

[21] Appl. No.: 738,234

[22] Filed: May 28, 1985

[51] Int. Cl.[4] ..... B07B 4/08; B07B 9/00

[52] U.S. Cl. ..... 209/44; 209/414; 209/475; 209/506

[58] Field of Search ..... 209/44, 19, 34, 468, 209/475, 483, 502, 506, 466, 474, 414, 318, 319

[56] References Cited

U.S. PATENT DOCUMENTS

| | | | |
|---|---|---|---|
| 402,094 | 4/1889 | Meginness | 209/475 |
| 412,741 | 9/1889 | Freeman | 209/468 |
| 448,961 | 3/1891 | Huseman | 209/468 |
| 460,732 | 9/1891 | Taylor | 209/475 |
| 512,918 | 1/1894 | Stewart | 209/468 |
| 570,243 | 9/1896 | Woods | 209/468 |
| 588,252 | 8/1897 | Waer | 209/475 X |
| 879,481 | 2/1908 | Mait | 209/475 |

*Primary Examiner*—S. Leon Bashore
*Assistant Examiner*—Thomas M. Lithgow
*Attorney, Agent, or Firm*—Burns, Doane, Swecker & Mathis

[57] ABSTRACT

The present invention relates to an improved portable lightweight apparatus for the separation of gold and similar metals from pulverized ore, sand, debris and the like. More particularly, the invention is a portable lightweight apparatus which uses currents of air to separate gold from sand and debris, in which the apparatus includes in combination a frame, an optionally detachable screen rack, an optionally detachable hopper, an inclined riffle board which contains holes through which air currents jet and an attached bellows to provide the currents of air to separate the gold particles from the debris, and a means to operate the bellows one side of which is in combination with the riffle board and a means to operate the bellows. In one instance, one solid side of the bellows is the bottom of the riffle board.

9 Claims, 7 Drawing Figures

PORTABLE APPARATUS FOR THE RECOVERY OF PLACER GOLD

FIELD OF THE INVENTION

This invention relates to an improved portable apparatus for the separation of gold and other heavy metals from pulverized ore, sand, dirt and the like.

BACKGROUND OF THE INVENTION

It is known in the art to separate particles of gold and other heavy metals from lighter weight dust and dirt by use of a current of water. Apparatus to perform this function with water range from relatively small, e.g. a swirling basin of water containing gold-bearing soil, to very large, e.g. focusing a high-speed water jet on gold-bearing soil and allowing the water-soil mixture to trickle over one or more riffle boards. The first method is extremely slow and time consuming, and the second requires an available large supply of water, and also generates a large amount of debris, so much so that large-scale hydraulic mining is illegal in all states.

To circumvent the problems of hydraulic mining, some have reported the use of air separation of metals. For instance, Snee in U.S. Pat. No. 839,329, discloses the details of an air separation of metals from ores. This device includes a hopper arrangement whereby the raw ore is fed into a hopper and directly impinges on a screen separator. Beneath the screen arrangement is a supplemental chute leading to and discharging into a box which forms a part of a separating chute. The upper portion of the chute serves to remove the coarser portions of the material thrown into the hopper and to deliver the smaller screened and more valuable ore particles to the chute there beneath. The lower chute is in communication with the discharge end of a fan by means of a duct or air passage. The sieved or sifted ore enters the chute and is met by an air blast from an air chamber which carries the lighter portions of the screened ore particles over the opening forming the chute. The openings have inwardly and rearwardly inclined sides. The metals and other heavy metal-containing particles drop to the floor of the chute. The chute may also be caused to vibrate in a side-to-side manner so as to cause the material to slowly travel downward and be constantly agitated so as to give the air blast more of an opportunity to remove the lighter dust particles from the ore. The device of Snee involves a single large flow air blast to separate the metals from the dust and dirt. In addition, Snee does not disclose a light-weight portable ore-separating apparatus or one in which certain elements of the apparatus are detachable to enhance the portable nature of the apparatus.

Other disclosures of general interest include those which describe the cleaning of dust and debris from grain. For instance, Hatfield, in U.S. Pat. No. 1,985,167, discloses the use of a grain cleaning apparatus that incorporates a crank-operated fan to provide an air flow for separating dust, debris and chaff from grain. The air flow passes over the grain that has settled in the depression of an inclined slideable arm to the crank, so that agitation of the board results from the operation of the crank. Also, in U.S. Pat. No. 1,321,263, Vaughn describes a grain separator having a series of screens, a feed roll hopper assembly having a fan, and a chute to provide an air blast to further separate the dust from the grain. Further, in U.S. Pat. No. 2,071,267, Schneider discloses an apparatus for the cleaning and separation of grain, and also for the separation of grain by size. The grain is passed through a series of progressively smaller sieves. A blast of air entering in a perpendicular direction to the screens is used to remove chaff and other foreign substances from the grain.

While the above references describing the separation of grain from lighter materials, such as chaff, may be of general interest, none suggest their adaption to treat a material as different as metal and rock nor do they teach a portable lightweight apparatus as described in the present invention.

It is therefore an object of the present invention to provide a portable lightweight apparatus for the air separation of metals, such as gold, from lighter weight materials.

It is a further object of the present invention to provide a portable lightweight apparatus which is compact and has certain elements, such as the separator and hopper, which are easily detachable to improve portability.

Another object of the present invention is providing an apparatus of the above-cited character which is simple and durable in construction, reliable and efficient in operation and inexpensive to manufacture.

Other objects and advantages of the invention will be apparent during the course of the following description.

SUMMARY OF THE INVENTION

In one aspect, the present invention relates to a portable light-weight apparatus mounted on a frame system which permits a detachable sloped screen to separate and reject large chunks of ore or debris and pass smaller ore particles to a detachable hopper arrangement.

In another aspect of the present invention, the hopper is mounted beneath the screen to collect the smaller particles which have been separated and collected therein and discharge the particles onto a riffle board.

In a further aspect of the invention, the riffle board is provided with a plurality of holes through which air jets are directed so as to carry off light weight debris while retaining heavier metal particles on the riffle board. The air jets are provided by a bellows mechanism. The invention also contemplates means for operating the bellows.

In a further aspect of the present invention, a portable lightweight apparatus is utilized to achieve the air streams or air jet separation of heavy metals, such as gold, from lighter weight materials such as rock and other debris.

Other aspects of the present invention are described hereinbelow.

DETAILED DESCRIPTION OF THE DRAWINGS

Referring now to FIGS. 1 through 7 as needed, the portable apparatus for the separation of heavy metals from soil and the like is described. The separation of gold will be used in this description, but it is to be understood that any comparable heavy metal may be separated from sand, soil, pulverized ore, rock, debris or the like.

Figure 1:
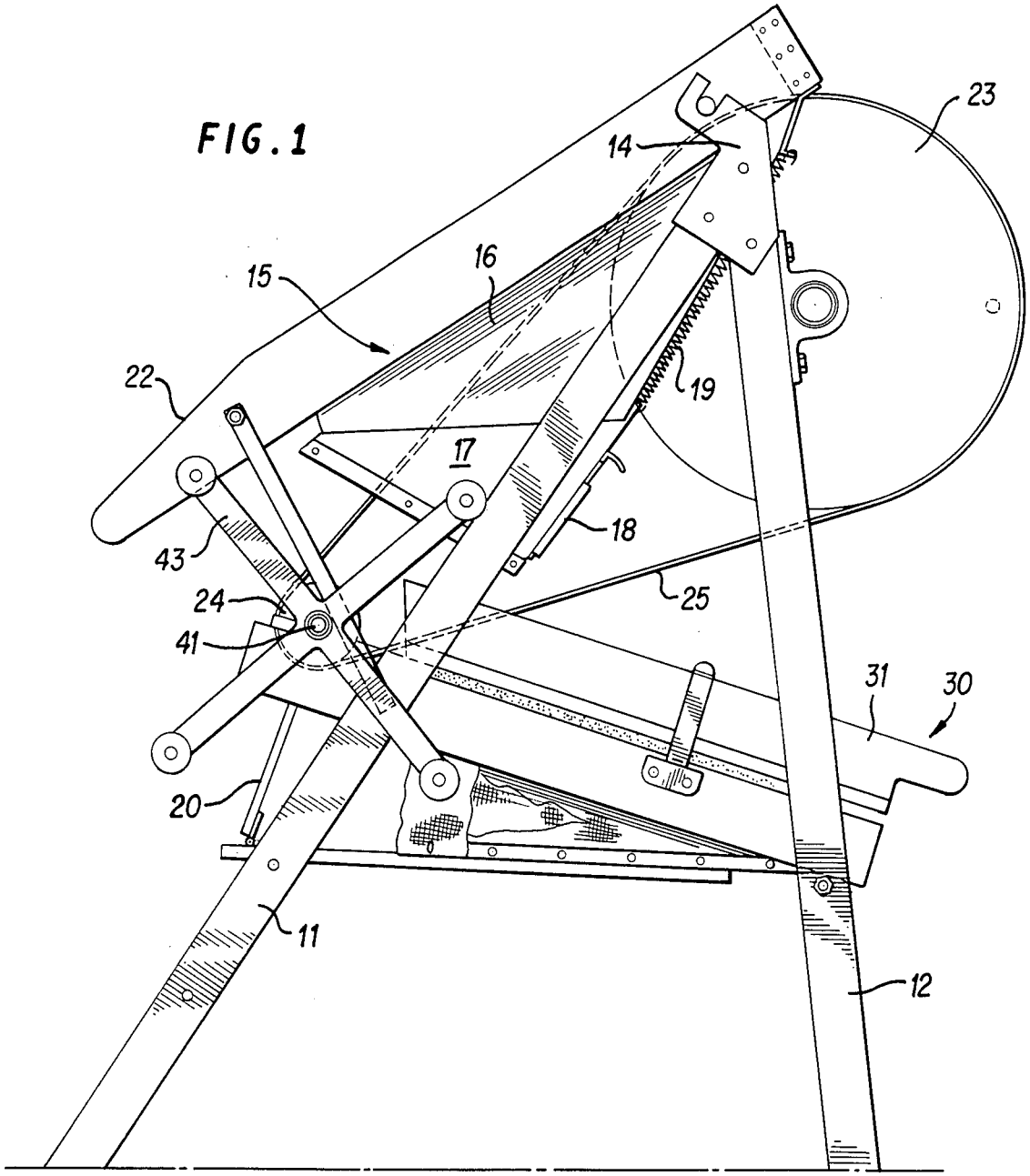
FIG. 1 is a right side view of the portable separator apparatus.

FIG. 1 shows a right side view of the portable metal separator apparatus. The frame of the improved separator includes four legs arranged in front and rear pairs 11 and 12, respectively. The legs of each pair are rigidly connected near the lower ends by a pair of relatively wide transverse cross-pieces 13. To give stability to the frame, the legs 11 and 12, on each side of the apparatus are arranged, in one embodiment, so as to converge at the top and be "spread out" at the bottom so as to provide a stable support. The top frame of legs 11 and 12 may be rigidly joined to a metal or like connector 14 which provides a connection between the legs. Preferred materials for the frame and connector are lightweight materials, such as wood, plywood, aluminum, tubing and the like to enhance portability of the apparatus. The apparatus is lightweight for portability, yet is sufficiently rugged to withstand having quantities of rock, soil, sand, etc. being thrown onto it.

Figure 2:
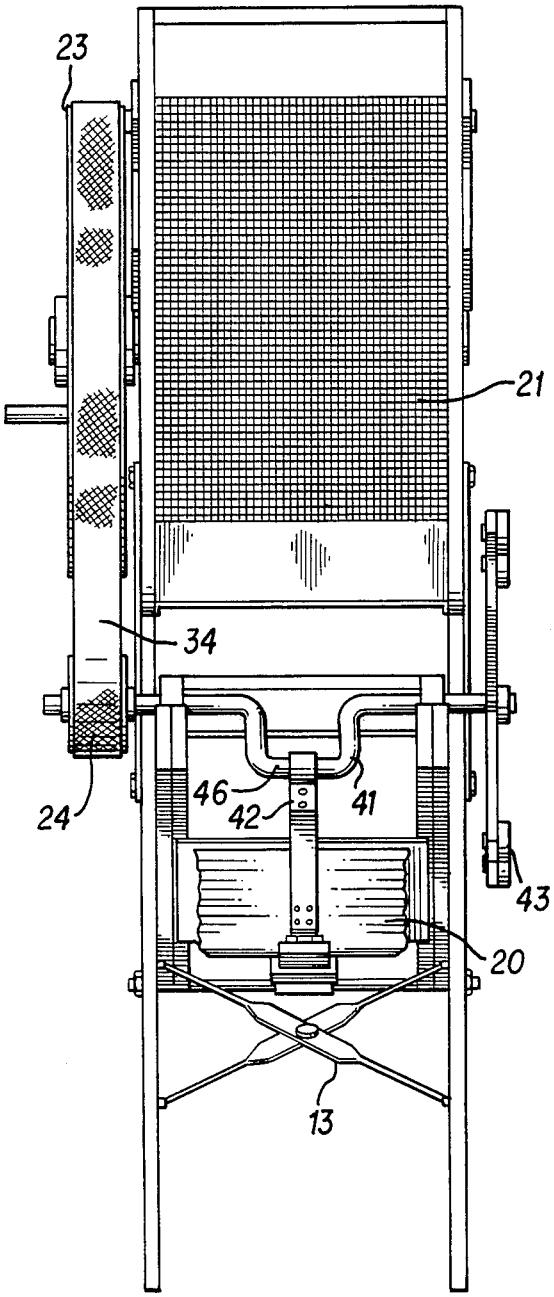
FIG. 2 is a top plan view of the separator apparatus.
Figure 3:
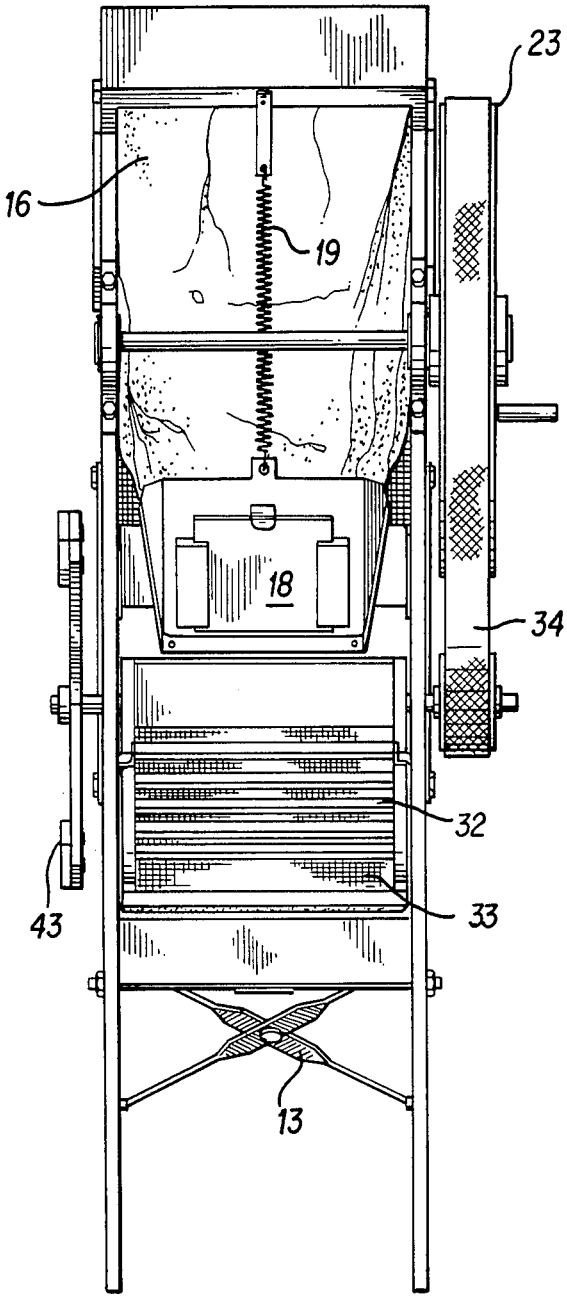
FIG. 3 is a bottom plan view of the separator apparatus.
Figure 6:
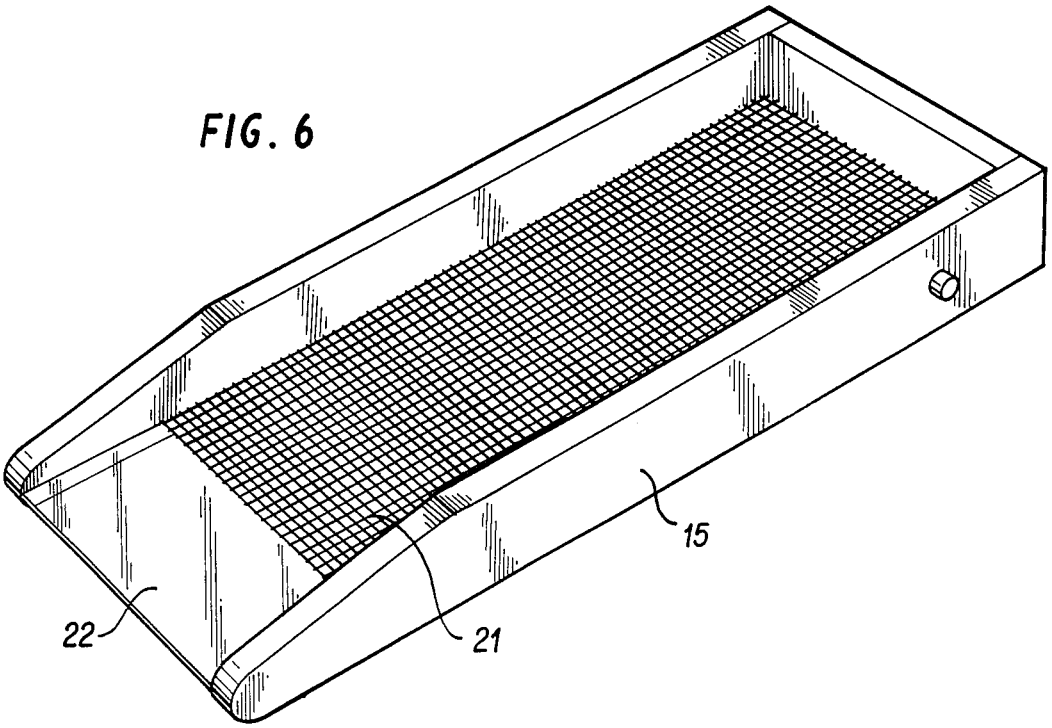
FIG. 6 is a perspective view of the hopper.

Mounted at the top of the rigid apparatus frame is a screen support frame 15 provided with a screen 21, which is shown in a better perspective in FIG. 2. Screen support frame 15 is usually made of wood or lightweight metal. The size of the screening mesh of screen 21 may range from between about 0.1 inch by 0.1 inch to 1 inch by 1 inch, and is usually placed in the lower portion of frame 15 as is shown in FIG. 6. A waste discharger section 22 is provided on the frame 15. Because of the nature and size of the ore or dirt which is delivered to the frame 15, waste discharger 22 is usually constructed of sheet steel, such as 18 gauge steel, for durability.

In a preferred embodiment, frame 15 as shown in FIGS. 1 and 6 is sloped between about 30° to 70° so that the oversized chunks are rejected and fall from waste discharger 22. The oversized chunks may be crushed and rescreened at a later time. The smaller ore particles fall into hopper 16 attached to the bottom of frame 15. Frame 15, shown in FIG. 1, is optionally detachable from the frame of the apparatus defined by legs 11 and 12 so as to enhance the portability of the apparatus.

Beneath frame 15 and screen 21 is a hopper 16, which is constructed of a durable material such as canvas, plastic or metal; however, heavy canvas is generally preferred. Hopper 16 may also be a detachable unit from frame 15 and screen 21, or may be permanently attached. In one embodiment, hopper 16 is also detachable from the frame of the apparatus to improve portability of the apparatus. At the lowest part of hopper 16 is feed unit 17 having an openable gate 18 with return spring 19 which is provided to bias the gate to a closed position. The feed unit 17 and gate 18 are usually constructed of sheet metal, and 18 gauge sheet steel is usually preferred.

Figure 4:
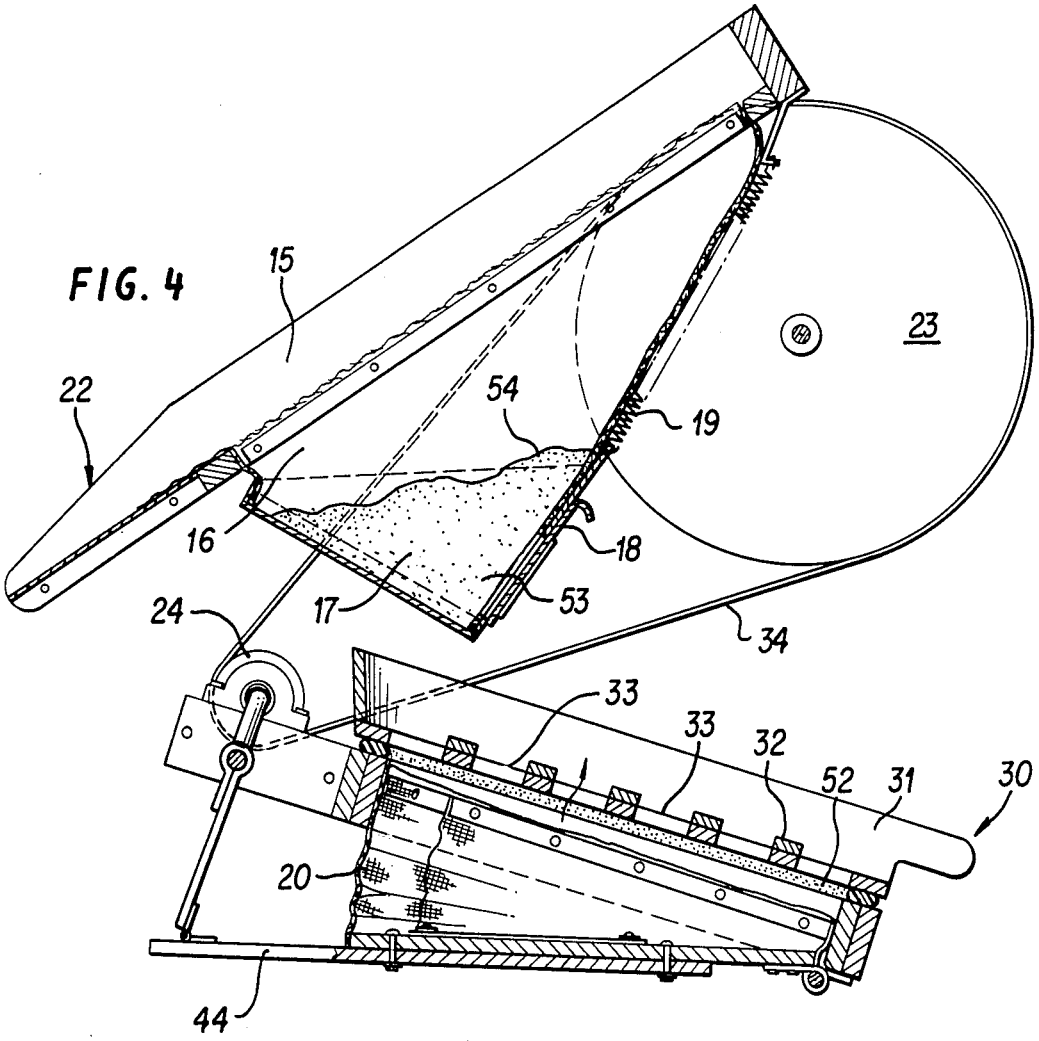
FIG. 4 is a partial side view of the hopper and riffle board shown without the support frame structure.
Figure 5:
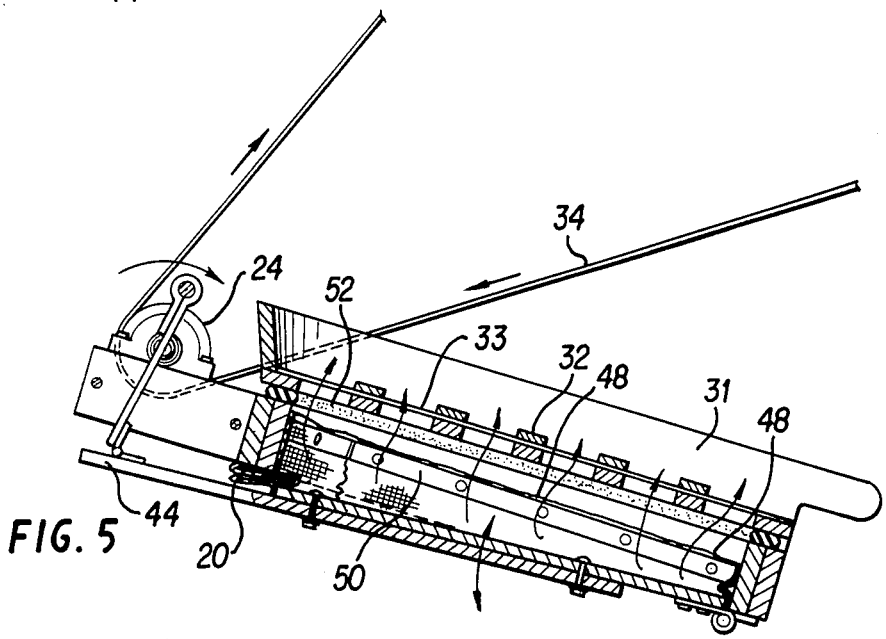
FIG. 5 is a partial side view of the riffle board and bellows assembly in one mode of operation.
Figure 7:
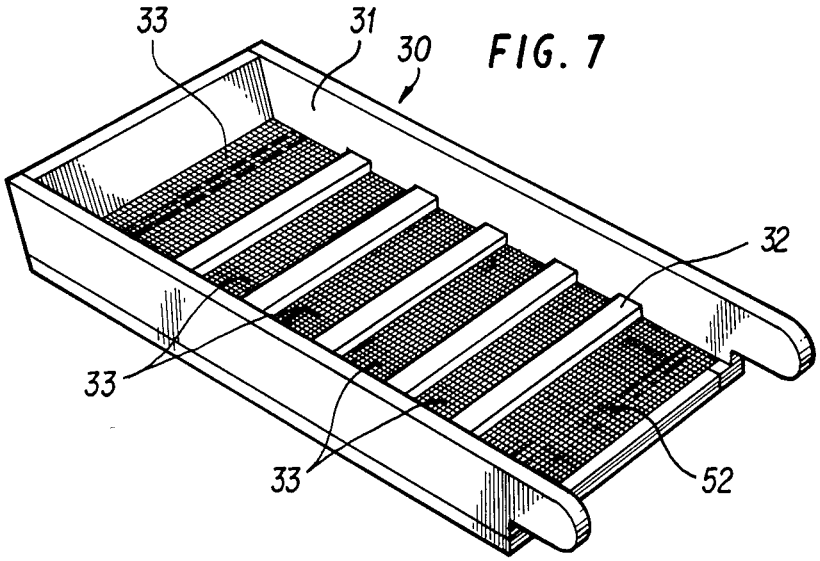
FIG. 7 is a perspective view of the riffle board.

As shown in FIGS. 4, 5 and 7, a riffle board 30 has a frame 31 and a series of small riffles or ledges 32. Defined between the riffles 32 are a series of troughs 33. The riffle board is positioned 30 at an approximately 30° angle with respect to the horizontal as shown in FIG. 1. The purpose of the riffles and troughs will be explained in more detail below.

With reference to FIG. 2, a drive mechanism is provided by a driving wheel 23 connected to a driven wheel 24. The wheels are connected by a pulley 34. A bellows assembly is indicated at 20 and is connected to the driven wheel 24 by a crankshaft 41. A connector strap 42 extends between the crankshaft and a movable portion 44 of the bellows 20. The strap 42 is connected to a U-shaped section 46 of the crankshaft 41. The U-shaped section 46 provides an offset with respect to the axis of the crankshaft 41 along the connection with the driven wheel 24. The offset permits rotary motion of the shaft to translate into reciprocating motion for operation of the movable portion 44 of the bellows 20. A counterweight 43 is provided to balance the belt driven crankshaft.

The bellows 20 operates in a normal manner by drawing air into the bellows during an expansion stroke of the crankshaft 41 and expelling the air from the bellows during the compression stroke of the crankshaft. FIG. 4 shows the position of the bellows during the expansion stroke and FIG. 5 shows the position of the bellows during the compression stroke.

With reference to FIG. 5, the bellows 20 is provided with openings 48 along a top side portion 50. The openings 48 direct the expelled air through a mesh screen 52 provided in the bottom of the riffle board 30. Due to the presence of the riffles 32, the air is expelled through the trough sections 33 of the screen 52.

In the operation of the separation apparatus, a metal-containing ore such as crushed gold ore or soil containing metallic gold 51 is placed on screen 21. Chunks of ore 52 which are too large to pass through screen 21 or frame 15 are rejected, and discharged by the waste discharger 22. Smaller particles of gold 53 and lightweight soil 54 pass through screen 21, are deposited in hopper 16 and collected in feeder 17. When gate 18 is opened, gold particles 53 and lightweight soil 54 are funneled onto the inclined riffle board 30. The angle of riffle board 30 from the horizontal is usually between 1° and 50°, and preferably about 30°. The jet of air created by the compression stroke of bellows 20 passes through openings 48 of the bellows and the troughts 33 defined by the riffles 32 and blows away lightweight debris which is discarded, due to the slope of the riffle board, leaving the heavier gold particles 53 on riffle board screen 52. The heavy gold particles 53 may then be collected by hand from the screen of the riffle board.

During the construction of the apparatus, care is exercised to select materials and component parts to obtain an apparatus which is lightweight and easily portable to remote sites where gold bearing ore or soil is located.

As discussed, the screen 21 and associated frame 15 and hopper 16 may be detachable from each other and from the frame to improve the portability of the apparatus.

While certain preferred embodiments of the invention have been shown and described herein, it will become apparent to those skilled in the art that various modifications and changes can be made in the process and article without departing from the spirit and scope of the present invention, as set forth in the claims.

What is claimed is:

1. A portable separation apparatus to separate a heavy metal from a metal-containing ore, comprising:

(a) a support frame including two pair of support legs converging at an uppermost end portion and diverging at a lowermost end portion, each pair of said support legs connected together at the uppermost end portion by a connection element;

(b) a screen provided with a screen frame, a first end of the screen frame directly and detachably engaged with said connection elements, a second end of the screen frame supported on one of said each pair of support legs in a region intermediate said uppermost and lowermost end portions, said screen frame provided so as to receive and reject large particles of the ore and pass smaller ore particles through said screen;

(c) a waste discharge chute integral with said screen frame;

(d) a hopper means detachably connected to said screen frame for receiving said smaller ore particles therein;

(e) discharge operating means connected to said hopper means for releasing said smaller ore particles from said hopper means;

(f) a riffle board positioned below said hopper to receive said smaller ore particles from said hopper means, said riffle board provided with a plurality of riffles and a plurality of troughs defined between said riffles;

(g) a bellows for expelling air being positioned so as to deliver said air through said troughs so as to separate and carry off light-weight debris while permitting heavier particles to remain in the troughs of the riffle board; and (h) means for operating said bellows independent of said discharge operating means.

2. The apparatus of claim 1 wherein the apparatus is constructed of lightweight materials.

3. The apparatus of claim 2 wherein the support frame is constructed of wood.

4. The apparatus of claim 2 wherein the support frame is constructed of aluminum.

5. The apparatus of claim 1 wherein the means for operating the bellows comprise a belt and wheel arrangement.

6. The apparatus of claim 5, wherein means for operating said bellows further comprises a crankshaft connected to said bellows and said belt and wheel arrangement comprises a driven wheel which drives said crankshaft.

7. The apparatus of claim 6, wherein the crankshaft has a U-shaped portion connected to a strap which transfers a reciprocating motion to said bellows.

8. The apparatus of claim 1, wherein said riffle board is inclined.

9. The apparatus of claim 7, wherein the crankshaft is balanced by a counterweight on a side of the crankshaft opposite the driven wheel.

* * * * *